United States Patent [19]

Eickmann

[11] Patent Number: 4,815,275

[45] Date of Patent: Mar. 28, 1989

[54] COMBUSTION ENGINE WITH EXTERIOR COMBUSTION CHAMBER

[76] Inventor: Karl Eickmann, 2420 Isshiki, Hayama-machi, Kanagawa-ken, Japan

[21] Appl. No.: 124,534

[22] Filed: Nov. 16, 1987

Related U.S. Application Data

[63] Continuation-in-part of Ser. No. 828,116, Feb. 10, 1986, Pat. No. 4,716,720, which is a continuation-in-part of Ser. No. 522,959, Dec. 8, 1983, abandoned, which is a continuation-in-part of Ser. No. 184,687, Sep. 8, 1980, abandoned.

[51] Int. Cl.[4] ..... F02G 3/02

[52] U.S. Cl. ..... 60/39.6; 55/409; 60/39.464

[58] Field of Search ..... 60/39.6, 39.62, 39.63, 60/39.46 S; 55/403, 406, 409; 123/41.35, 79 C; 137/596, 627.5

[56] References Cited

U.S. PATENT DOCUMENTS

| | | | |
|---|---|---|---|
| 708,236 | 9/1902 | Leonard | 60/39.6 |
| 898,139 | 9/1908 | Roberts | 123/79 C |
| 1,062,999 | 5/1913 | Webb | 60/39.6 X |
| 1,589,566 | 6/1926 | Ruths | 123/90.28 X |
| 1,610,314 | 12/1926 | Porter | 123/41.35 X |
| 1,688,978 | 10/1928 | McCallum et al. | 417/558 |
| 2,151,759 | 3/1939 | Hardensett | 60/39.62 X |
| 2,497,781 | 2/1950 | Logashkin | 123/41.35 |
| 2,895,564 | 7/1959 | Borie | 55/409 |

FOREIGN PATENT DOCUMENTS

| | | | |
|---|---|---|---|
| 341746 | 6/1904 | France | 123/79 C |
| 496692 | 8/1919 | France | 60/39.6 |
| 521109 | 2/1921 | France | 60/39.6 |
| 52897 | 6/1944 | France | 55/409 |
| 203767 | 9/1923 | United Kingdom | 123/79 C |

*Primary Examiner*—Michael Koczo

[57] ABSTRACT

A combustion engine has a combustion chamber separated from the compression and expansion chamber(s). Passages are provided between the combustion chamber and the compression chamber(s) and the combustion chamber and the expansion chamber(s) with respective valves in the passages and inlet and exhaust valves provided in the combustion and expansion chamber. The combustion chamber maintains the combustion after passing fuel into the compressed air received from the compression chamber. The valves and piston heads are formed to prevent dead space in the cylinders in order to obtain a good efficiency by full discharge of the compressed air into the combustion chamber. Fuel cleaning means like, for example, a rotary separator and pure gas collecter are provided in the combustion chamber to separate unclean fuel particles, as, for example, ash or sand in coal, from the burned gases and collect the unclean particles in separated collection spaces. The engine can thereby burn unclean fuels, as for example coal powder or coal sludge and the like. The valves can be timed for different styles of combustion cycles if so desired. The engine may use conventional four stroke or two stroke engine arrangements and provide them with combustion chambers, pistons and cylinder heads of the invention to modify them from gasoline combustion to coal combustion or other cheaper and more avialable fuels for the combustion in the compressed air.

8 Claims, 5 Drawing Sheets

Fig. 4
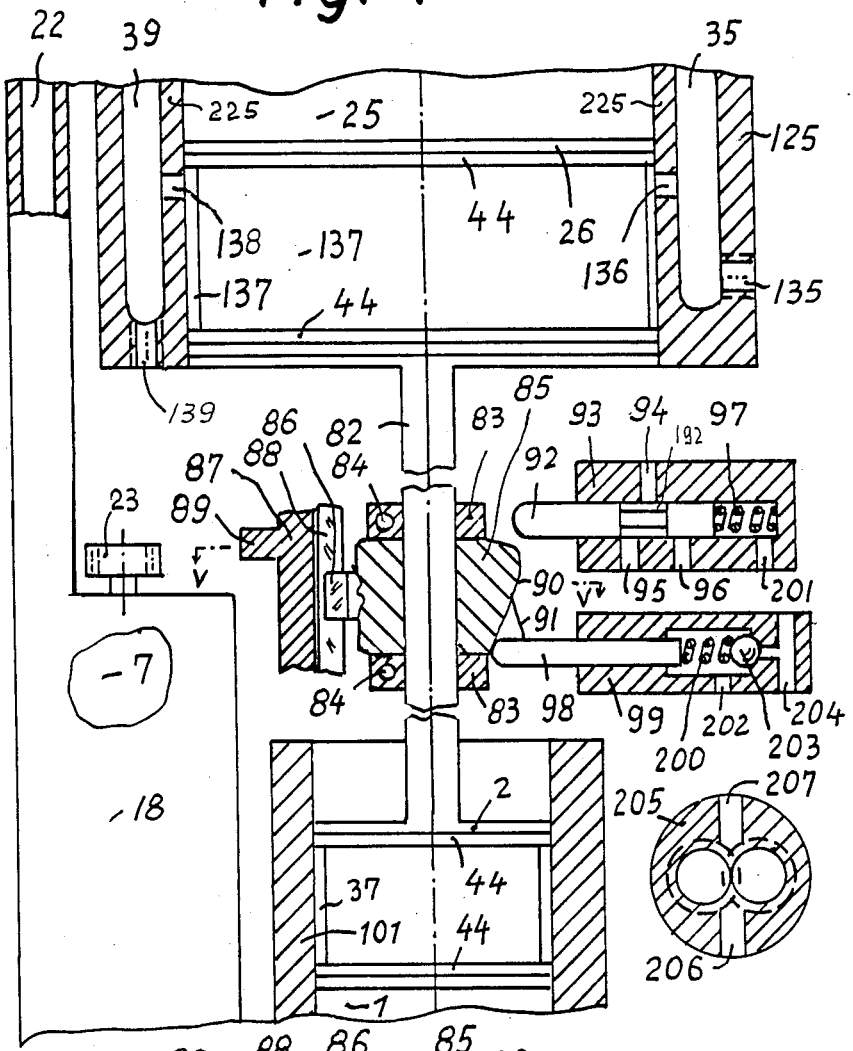
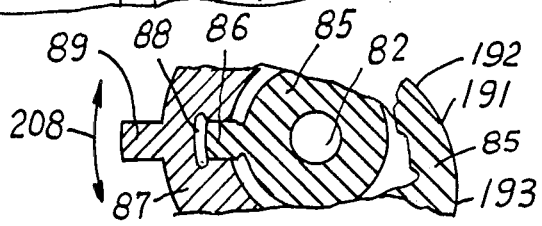
Fig. 5

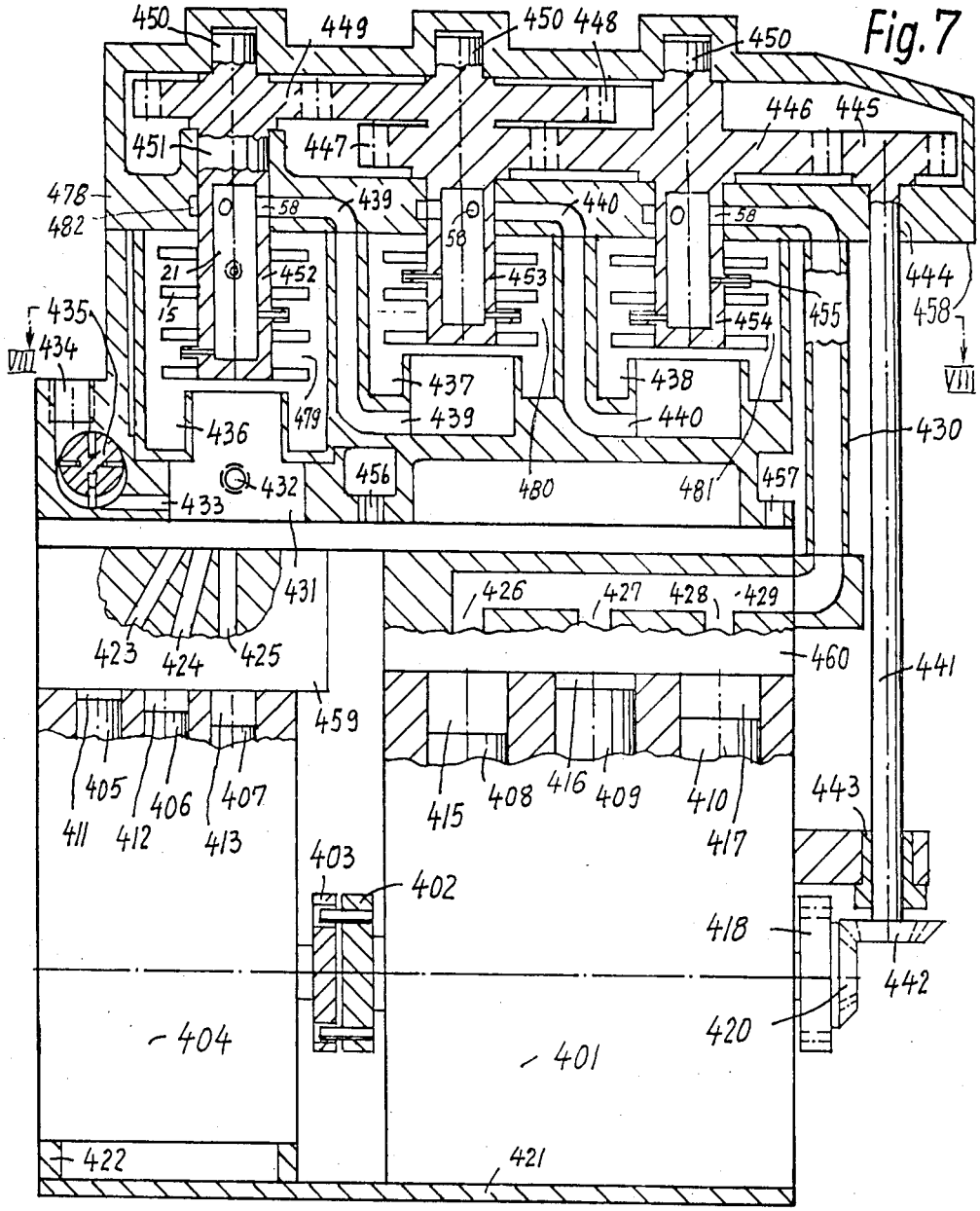
Fig.8
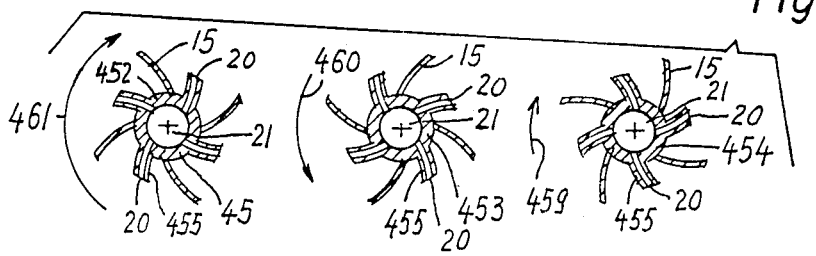

COMBUSTION ENGINE WITH EXTERIOR COMBUSTION CHAMBER

REFERENCE TO RELATED APPLICATIONS

This is a continuation in part application of my application Ser. No. 828,116, filed on Feb. 10, 1986, now U.S. Pat. No. 4,716,720, issued on Jan. 8, 1988, and which was a continuation in part of my earlier application Ser. No. 522,959, now abandoned and which was filed on Dec. 8, 1983 as a continuation in part application of my on Sept. 8, 1980 filed application Ser. No. 184,687 which is now also abandoned.

DESCRIPTION OF THE PRIOR ART

Common engines have pistons reciprocating in cylinders and they burn fuel in the compressed air in the cylinders. Literature shows that there have been attempts in the first half of this century to burn coal powder in such engines. However, the residue of coal and unpure coal which remained in the cylinders temporarily wore the pistons and the cylinder walls out too much, so that further development of coal powder engines was discontinued. The hope to obtain a perfect coal powder combustion engine faded away. I myself have done considerations for rotary coal powder engines at end of WWII but had to stop them because of lack of financing. More details are presently not known to me about the prior art.

The literature, especially the engineering hand books and college books commonly report only that attempts of the first half of our century to burn coal in engines have been abandoned because of the heavy wear and wear out of cylinders and walls. The realities are thereby seldom known to persons and hid from them. It is therefore very important that a new investigation was done by Soehngen and associates during 1976 and reported to the US Energy Research and Development Administration under title: "Development of coal burning Diesel engines in Germany" by E. E. Soehngen. Luckily applicant became aware of this report, which is otherwise rather unknown. This report is very important in the art and shows that the problems of wear and the problems of cleaning the coal from ashes were overcome in a large degree already in the first half of our century. During the examination of my parent patent application and during examination of some of my copending patent applications it has come to light that the major inventions in combustion engines were already done during the last half of the last century or very early in our present century. Patents, which issued at those times, are, for example,:

The Lenard U.S. Pat. No. 708,236 of Sept. 2, 1902 shows an external combustion chamber between a compressor and an expander. This patent also shows suitable valves, which reduce dead space.

The term "exterior combustion chamber" shall define in this application a chamber, which is not inside of a cylinder, but separated from a compressor and expander, while it is communicated to the compressor and the expander over respective valves, which open and close during operation of the device in periodic cycles.

The Webb U.S. Pat. No. 1,062,999 of May 27, 1913 discloses an engine which includes the features of the Leonard engine with self-acting valves of the compressor and outsidely actuated valves at the expander stage.

The Porter U.S. Pat. No. 1,610,314 of Dec. 14, 1926 discloses a fluid chamber around a piston, while fluid is passed therethrough at a specific ratio of the piston stroke.

The Hardensett U.S. Pat. No. 2,151,759 of Mar. 28, 1939 shows plural compressor cylinders and expander cylinders which act in combination with an external combustion chamber, whereby the respective pistons in the cylinders may supply compressed air or consume gas in succession.

The Logashkin U.S. Pat. No. 2,497,781 of Feb. 14, 1950 has a cooling chamber around a piston, whereby the cooling chamber acts at a certain ratio of the piston stroke and similar to that of the Porter patent.

The Holden U.S. Pat. No. 869,781 of Oct. 29, 1907 has co-axial inlet and outlet valves with tapered valve seats.

The Mc.Callum et all U.S. Pat. No. 1,688,978 of Oct. 23, 1928 brings co-axial valves with tapered seats and clear flow passes for a pump.

The Kitton U.S. Pat. No. 848,311 of Mar. 26, 1907 shows similar valves.

The Ruths U.S. Pat. No. 1,589,566 shows the actuation of the valve from the outside by mechanical means, and, The Odermann U.S. Pat. No. 600,841 of Mar. 15, 1898 appears to be one of the oldest patents, which shows co-axial vlaves with tapered seats for a pump.

There appear to be more patents of the former art, but they appear to merely repeat matters which are substantially shown in the above mentioned patents.

BACKGROUND OF THE INVENTION

The world suffers a shortage of oil and gasoline since the last decade. Great attempts have been made to liquify coal into fluid. Such attempts were successful in WW II in Germany and are successful nowadays in South Africa. New projects are now under development in USA, Japan and West Germany. However, these new developments are extremely expensive and after completion in about 1985 they will supply only the gasoline required for one single day of a year.

When coal is liquidified into gasoline or oil all the calories of the respective portion of coal are transformed into oil or gasoline with only a very few percent of losses in calories. However the process of liquidification requires high pressures, time and temperatures. Therefore, in order to run the liquidification process of coal two to three times more coal is used, than is transformed into oil or gasoline. Consequently, the liquidification process wastes 50 to 70 percent of the coal of the earth without transferring its heat value of calories into useable oil or gasoline.

This waste of coal could be almost entirely spared, if the coal could be burned directly in the engine without transforming it into oil or gasoline. The invention attempts to provide such engine for directly burning coal, coal powder, coal sludge or any other suitable fuel. At same time however it might also provide more powerful or more convenient gasoline or Diesel engines.

SUMMARY OF THE INVENTION

The object of the invention is to provide an engine which can burn fuels other than gasoline, for example, which can burn solid fuels, powdered fuels or sludges.

Especially it is desired by this invention to mill coal to powder or mix coal powder with liquid to sludge or an emulsion and to burn it in the engine of the invention.

The engine of the invention should be able, if materialized, to free the world to a very great degree from the shortage of gasoline and oil.

The invention further does an attempt, to modify common combustion engines into solid fuel burning engines or at least to make it possible to use a great portion of the engine building plants of today for the machining of similar engine parts without a complete change of production methods and facilities. Only some of the parts of the new engine would require different manufacturing facilities than those which are common in engine manufacturing plants today.

To obtain the object of the invention, a number of details of the invention may be applied.

The details of the aims and objects of the invention are further explained in the description of the preferred embodiments.

BRIEF DESCRIPTION OF THE DRAWINGS

FIG. 4 is a longitudinal sectional view through a portion of an embodiment of the invention;

FIG. 5 is a cross-sectional view through FIG. 4 along the arrowed line V—V of FIG. 4;

FIG. 7 is a sectional view through portions of an engine of the invention,

FIG. 8 is a sectional view through FIG. 7 along the arrowed line VIII—VIII of FIG. 7, and;

DESCRIPTION OF THE PREFERRED EMBODIMENTS

Figure 1:
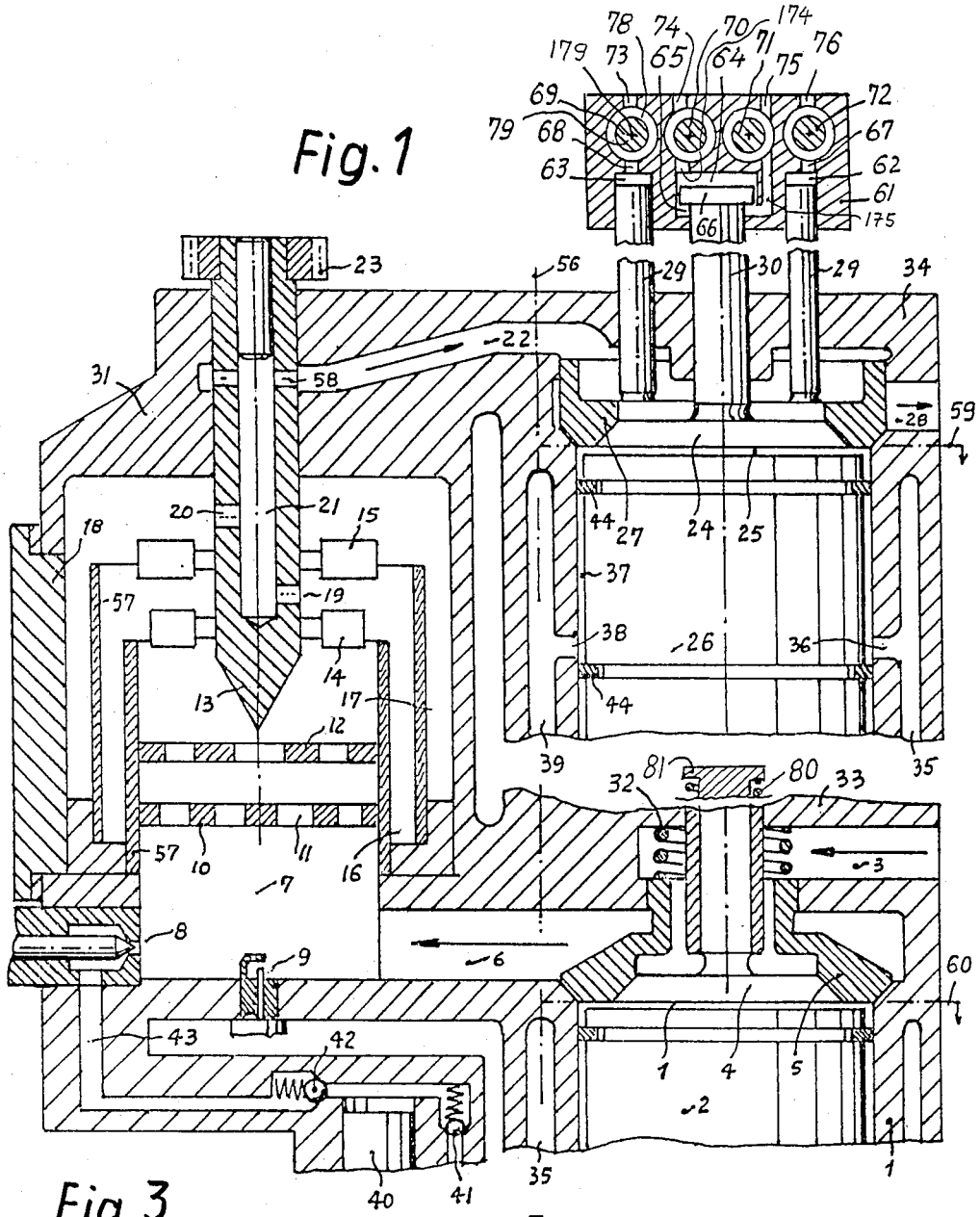
FIG. 1 is a longitudinal sectional view through a simplified embodiment of the invention, which is arranged in such a way as to show all important details in a simplified section in one sheet of a plane of paper.

In FIG. 1 the compression cylinder 1 has reciprocably therein the piston 2, which is driven in the conventional manner, for example by a crank shaft, a connecting rod, called "conrod", and a cross-bore and pin in the piston 2 to pivotably connect the piston to the conrod. The crankshaft obtains its power of rotation from the respective power stroke of a respective piston in the power-stroke or expansion stroke or it has an inertial revolving mass from an earlier power stroke.

The cylinder 1 could be any other form of chamber and so could the expansion cylinder 25. The pistons 2,26 could be any other suitable displacement means or moveable members, like rotors and the like.

When piston 2 moves downward in the intake stroke, the inlet valve 4, which is borne in compression discharge valve 5, opens and air or gas, which might be pre-compressed by a turbo or other charger, enters through inlet passage 3 and the opened inlet valve 4 into the compression cylinder 1.

When piston 2 starts moving upwards from its outer dead point towards its inner dead point in the upper portion of cylinder 1, the inlet valve 4 closes. A spring might be applied to assist this closing in combination with the changing pressures on its seat 4. As soon as the compression of the air or gas in cylinder 1 is as high or slightly higher than the pressure in the combustion chamber 9 is, the compression discharge valve 5 which is guided in the cylinder head 33, opens and the compressed air or gas is pressed out from cylinder 1 through the compression discharge passage 6 into the combustion chamber 9.

It is important here, that the cylinder 1 with it's cylinder head 33 together with the top of the piston 2 are preventing dead space in cylinder 1. Because, when there would be a large dead space in cylinder 1, too large a portion of the compressed air or gas would remain in cylinder 1.

Consequently the neighboring faces of piston 2, valves 4,5 and head 33 are to be so dimensioned, that, when the piston 2 is moved into its inner dead point position, the position most close to the cylinder head, there remains substantially no space in cylinder 1. For this purpose in the Figure, the piston head is flat and the valve top faces are also flat. The piston nears the bottom faces of the valves 4,5 very closely. For example, close as less than 1 mm or a tenth of a millimeter. Thereby almost all of the compressed air or gas is transferred from the cylinder 1 into the compression discharge passage 6. As soon as that is accomplished, the compression discharge valve 5 closes, which may be accomplished with the help of spring 32. A fast action of closing of valve 5 is often desired and important for a good efficiency of the engine.

Fuel pump 40 takes in the fuel, which might be gasoline, diesel oil, heavy oil, carbon-dust, coal powder, coal slug, coal - fluid emulsion, alcohol, mixtures or any suitable heat values or calories solid fuel when it is powdered fine enough or made to transportable emulsion, from the respective tank or container which might be under a slight pre-pressure, through inlet valve 41 of pump 40. This is done at the downward—or intake—stroke of fuel pump piston 40. At the thereafter following delivery stroke the fuel pump piston 40 delivers the fuel through exit valve 42 and through fluid line 43 to and through the injection nozzle or sprayer 8, whereby the fuel enters the combustion chamber 7 and therein mixes with the discharged compressed air or gas which is entering into the combustion chamber 7 from the compression discharge passage 6 as explained above.

Ignition means 9 ignites the fuel-air mixture and the burning, heating up and expansion of the gas occurs.

The combustion chamber 7 may be connected to a plurality of compression cylinders 1 and thereby to a plurality of compression discharge passages 6; to a plurality of power gas transfer passages and expansion cylinders 25 and also to a plurality of injection or spray means 8 with a respective plurality of pumps 40 with valves and passages 41,42,43.

The pluralities of nozzles 8, pumps 4, cylinders 1 and 25 with passages 6 and 22 may act in timed relation one after the other, whereby a permanent or almost permanent and uniform flow of compressed air or gas and fuel may enter into the combustion chamber 7 whereby a permanent combustion may be maintained in combustion chamber 7. In case of permanent continuing combustion, the ignition means 9 may be required only once for the start of the ignition, while thereafter at substantial permanent burning and combustion, the ignition means 9 may be stopped.

When there is only a single compression cylinder 1 connected to the combustion chamber 7 the supply of compressed air appears in timely separated compression discharge thrusts and the fuel pump 40 is then suitably geared to discharge the respective fuel spray thrust at suitable time and power through injection means 8 in timed relation to the compression discharge thrust from passage 6. This timing in relation to each other may also be done in any other suitable way, for example by timing the opening and closing of fuel delivery port or injection nozzle 8. A pressurized tank may be connected to passage 43 to collect therein fuel under pressure in order that, if so desired, an opening and closing of injection nozzle 8 by timing in relation to the compressed air discharge thrusts may accomplish the good mixing of air or gas and fuel at right time and in right quantity.

If there are enough compression cylinders 1 and expansion cylinders 25 communicated to combustion chamber 7, it is, however, possible to uphold a permanent flow of compressed air and of fuel into combustion chamber 7 with only minor fluctuations apart from a complete uniformity of such flows. The combustion will be more uniform and more permanent as more cylinders 1,25 are communicated to the combustion chamber 7.

The direction of injection of fuel may be substantially in a direction opposite to the compression discharge flow direction of the compressed air from passage 6, as is shown in the Figure. Ignition means 9 and injection nozzle or fuel supply outlet 8 are preferred to be exchangeable parts for easy assembly to and disassembly away from the combustion chamber 7.

As soon as the fuel is ignited in the compressed air it moves foreward in the combustion chamber 7 which is upwards in the Figure. The combustion chamber 7 may contain catalysts, cleaners or heat resistant filters or supports therefore, which are shown in a schematic by 10 and 12 with openings or passages of small cross-sectional areas for filtering and cleaning therein and shown by 11. The combustion chamber may also contain separator walls 57 to hold the dust or unpure residues of solids in dust collection chambers 16 and / or 17. These separators 57 may hold the supports of catalysts 10, 12 and the entire assembly of walls 57 with inserts 10, 12 may be removeably mounted and kept in the combustion chamber 7 by combustion chamber door 18. By opening it, the inner parts 57, 10, 12 with the unburned dusts and unclean particles collected in dust-chambers 16, 17 therein, can be removed from the combustion chamber, can be cleaned and again inserted into the combustion chamber 7 by closing the combustion chamber door 18.

Combustion chamber head 31 bears rotatably therein the rotary collection member 13 which is revolved by gearing means 23, for example, from other moving or revolving parts of the engine. It's speed of rotary angular velocity should be properly set to permit it to fulfill its functions properly. The rotary collection member 13 extends from the combustion chamber head 31 considerably deep into the combustion chamber 7. It contains the pure-gas passage 21 which has substantially radial or otherwise directed openings 19 which are located inside of the combustion chamber 7 to communicate the combustion chamber 7 with the pure gas passage 21. Preferably within the bearing in head 31 the rotary collection member 13 has again passages or bores, for example, radial bores 58 which communicate to the power gas transfer passage 22 in chamber head 31.

Rotary collection member 13 is provided with or drives its radial fins, arms or blades 14 and/or 15. When the rotary collection member 13 revolves in combustion chamber 7 and the burned or burning fuel - air mixture or gas moves forward in combustion chamber 7, in the Figure upwards in the chamber 7, the blades 14 and/or 15 are revolving the gas or air mixture and thereby the burning or burned gas starts to rotate in the combustion chamber 7. When there are still heavier than gas solid particles in the mixture, which have not burned and which are called dust, unclean particles or unpure particles in this specification, they experience at the rotation of the mixture in the chamber 7 a centrifugal force of a higher radial component than the lighter hot burned gas experiences. Thereby a separation process occurs which throws all unburned heavy dust particles radially to the outside in the combustion chamber 7 while the clean burned and lighter gas collects in the medial area close to the rotary collection member 13 in the combustion chamber 7.

The effect of this separation—or cleaning—process is, that the unburned solids, including sand, ashes, little stones, little portions of minerals or of metals which were in the coal or other fuel and the like, are collected as dust in the outer peripheral portions of the combustion chamber 7, where they are then descending into the dust collection chambers 16 or 17. But the so cleaned clean gas or pure gas enters through bores 19 into the pure gas passage 21 in rotary collection member 13 and flows from there through the outgoing passages 58 into the power gas transfer passage 22 in combustion chamber head 31.

Whether there is only one passage 19, one blade 14, or 15, one separator wall 57 or plural passages 19,20,58,21, blades 14,15, plural separator walls 57 and dust collection chambers 16,17 and plural filters or catalysts 10,12, is a matter of actual design.

It is preferred to set the passages 19,20 axially endwards of the respective blades 14,15 in order that the area where the passages 19,20 port into the combustion 7 is already cleaned from solid particles by the blades 14,15 of rotary member 13. Sometimes in actual design the blades 14,15 can be small or even left away, when the rotary velocity of rotary collection member 13 is high enough to assure that the probably present solid particles will not be tracted into the puregas passage 21 but be thrown radially away from the rotary member 13 when they are subject to the rotation of it and thereby to radially directed centrifugal forces which would throw them radially away from the rotary collection member 13.

The combustion chamber 7 with its head 31 may be integral with the engine housing or cylinders, but it is often preferred to have separated portions, which are bolted together in the face of the dotted line 58. Then there will be a cylinder head block, 33,34 and a combustion chamber block 7,31. There can also be pluralities of them.

While in the Figures all major components are drawn on the plane of a sheet of paper, it may be noted and be considered, that a common cylinder line engine commonly has a plane face on top of the cylinder block whereupon the cylinder head, containing the valves and passages is mounted. Line 56 in FIG. 1 may also represent such plane face on top of the cylinder block of the common cylinder-line engine. The combustion chamber block 7,31 together with the cylinder head block 33 and 4 with the passages, valves and accessories therein, may, if so desired and properly designed and built, be bolted onto the top face of such common line engine cylinder block. The setting face would then be a plane face along the lines 59-56-60 in FIG. 1. And these lines would have to be transformed into a plane face, where upwards of said face 59,56-60 the entire combustion engine block 7,31 with cylinder heads 33 and 34 would have to be built and respectively communicated and set with its members. Portions thereof may then extend laterally.

From power gas passage 22 the expanded or still expanding gases move towards the power gas transfer valve 24 in chamber head 34. A respective valve control device, not shown in the Figure, because its components can be of conventional nature, but with a novel timing to be adjusted to the conditions of the engine of this invention, should be assembled to head 34 for proper actuation of opening and closing of valves 24 and 27.

As soon as the valve control device opens the power gas transfer valve 24 or—also that is a possibility—as soon as the piston 26 in expansion chamber or expansion cylinder 25 has passed over its inner dead point and starts to move downward, whereby the pressure in cylinder 25 would be below the pressure in the power gas transfer passage 22 and thereby the pressure on top of valve seat 24, the power gas transfer valve 24 opens and the power gas flows from power gas transfer passage 22 into the expansion cylinder 25 and forces the power stroke or expansion piston 26 downwards in the respective power stroke of the engine.

When the described self-opening effect under higher pressure in power gas passage 22 and on top of valve seat 24 is applied, the valve 24 would never close itself as long as the piston 26 moves away from the cylinder head 34 and from valve 24. The engine would then be very powerful because full combustion pressure would act at the entire power stroke and the fully compressed power gas would then expand through the exhaust port 28 when the movement direction of the piston 26 reverses. The big power of the engine would then be accompanied by a very bad efficiency of the engine, because the expansion of the power gas would not be utilized but left unused and passed out of the exhaust passage 28.

It is therefore better and also in accordance with this invention, to increase the efficiency of the engine at the expense of the power of the engine by setting the mentioned valve control device to the valves 24 and 27 of the expansion chamber to let them not open and close themselves, but to direct and enforce the timing of opening and closing of these valves.

The time of closing of power gas transfer valve 27 in relation to the ratio of extent of expansion or downward movement of power piston 26 defines the ratio of compression discharge gas to the power expansion gas volumes. It thereby defines the power and efficiency of the engine. The power to drive the compression stroke(s) is taken away from the power stroke of piston(s) 26.

For the purpose of the controlled opening and closing of the mentioned valves, valve 24 has its valve shaft 30 in the common manner to be engaged by the valve control device. The surrounding valve 27 however requires at least two radially from each other separated valve shafts 29 to be engaged by the valve control device. Because when both valves 24 and 27 surround each other, there cannot be any chamber head portion 34 between one shaft and a cylindrical shaft surrounding it. Another possibility, not shown in the Figure is, however, to set a cylindrical shaft onto valve 27 and to guide shaft 30 of valve 24 in said cylindrical shaft of valve 27 and to guide the cylindrical shaft of valve 27 in the chamber head 34. Then both valve shafts would be guided. In such case however, the cylindrical shaft of valve 27 requires a portion between the cylindrical guide portion and valve seat 27 with substantially radial or inclined passages and a space between valve seats 24 and 27 to permit the flow from power gas transfer passage 22 through the respective valve portion of valve 27 and then through valve 27 along the opening valve seat 24.

When the movement direction of piston 26 reverses and the piston 26 starts its upwards or exhaust stroke, the exhaust valve 29 either opens by itself or is opened by the valve control device and the gas flows then out of the expansion chamber or cylinder 25 over exhaust valve 27 and through exhaust passage 28 out of the engine.

Figure 3:
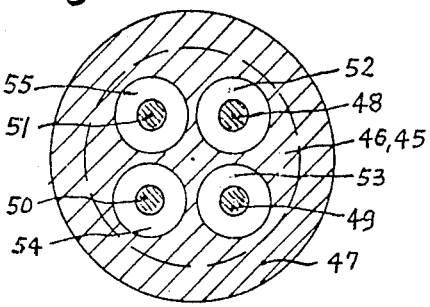
FIG. 3 is a cross-sectional view through FIG. 2 along the line III—III.
Figure 2:
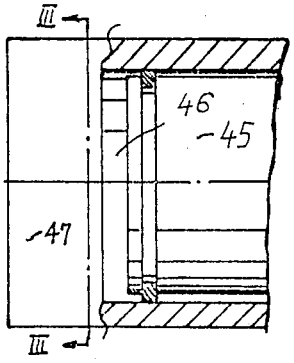
FIG. 2 is a longitudinal view through a portion of another embodiment of the invention, partially in a sectional view and partially in a view onto it.

FIGS. 2 and 3 demonstrate how a single cylinder or chamber 46 with a single piston or moveable member 45 can be operated as the engine of the invention. Thereby the engine could be a one cylinder engine. But it would also be possible to mount a plurality of such self sustaining single cylinder-units into an arrangement of a multi-chamber or multi-cylinder engine.

The working chamber 46 receives for that purpose a valve head or cylinder head 47. What is important in this present invention is that the cylinder head 47 must have preferably four passages and valves to said passages, namely 48 to 55 and they must open and close in timed relation to the movements of the moveable member or piston as described before.

The importance is that in such self sustaining single cylinder unit, the valves must be opened and closed in timed relation to the movement of the piston, as explained above. For this purpose the cylinder head 47 should be connected to the combustion chamber as explained at hand of FIG. 1 and the valve head or cylinder head 47 should contain the inlet passage 52 with inlet valve 48; the compression discharge passage 53 with compression discharge valve 49; the power gas passage 54 with power gas valve 50 and the exhaust passage 55 with exhaust valve 51.

In cylinder 25 another feature of the invention is illustrated. Cooling space 35 in the wall of cylinder 25 has a passage 36 which extends through the cylinder wall portion into the interior space of cylinder 25. Piston 26 has piston rings 44 on its upper portion and on its bottom portion. Thereby a space 37 is formed between the piston rings 44, the piston 26 and the inner wall of cylinder 25. Another passage 38 extends from cylinder 25 through a portion of its wall into cooling space 39. It is preferred to provide passages 36 and 38 on opposite sides of piston 26. The passages 36,38 pass fluid, namely cooling and sealing fluid into space 37 which thereby either becomes a cooling space or a sealing space, because the fluid may be liquid or gas of a higher viscosity and thereby effectively seal space 37 against less viscosity gas of the cylinder chamber 1 or 25. It is also possible and in a practical application often preferred to have a higher pressure in chamber 35 than in chamber 39 or vice versa. The sealing or cooling fluid, for example oil, water emulsion, would flow from cooling space 35 under higher pressure through passage 36 into chamber 37 and around piston 26, along the piston wall and cylinder wall 25,1 and out of cooling or sealing space 37 through passage 38 into the space 39 of less pressure. In case of reversed pressure the flow would be reversed. For this application, the passages 36 and or 38 must remein within the space of movement of the piston rings 44. The effect is very good and can be controlled either for very effective cooling by continous cooling flow along the decisive surfaces of the hot cylinder and piston or for perfect sealing without any loss of gas from the chamber 25, 1,46 along the respective piston 2,26,45.

In FIG. 1 it is also seen that valve 24 has a shaft 30 and valve 27 has plural shafts 29, whereby these shafts constitute actuator means, which extend outwardly from the guide portion of cover or housing 34 wherein they are guided. These shafts are connected or associated to a control device 61. The control device may act electrically, electronically, pneumatically, hydraulically or mechanically. In the Figure the control device works hydraulically or pneumatically and consists of controller housing 61 with control chambers 62 to 65 and control elements 69 to 72. The ends of the shafts or actuator means 29 and 30 extend into the mentioned control chambers. For example, shaft 29 into chamber 63 and another shaft 29 into chamber 62. Shaft 30 extends into chambers 64 and 65, wherein it forms a piston 66. The control chambers are provided with passages 68,67,174 and 175. These passages extend into control spaces 78, wherein control pistons 79 are able to move along axes 179. Control piston 79 is provided between passage 68 and entrance port 73. Control piston 70 is provided between passage 174 and port 74. Control piston 71 is provided between passage 175 and port 75, while control piston 72 is provided between passage 67 and port 76. Each control piston has a closing portion 69 and an opening portion 68, which forms a recess 78. When the respective control piston moves along its axis 179 it either opens or closes the respective port to the respective passage or the respective passage to the respective port. In the Figure, the control pistons are shown in opened position, whereby the annular recesses 78 communicate the passages with the ports and the ports with the passages.

If fluid under pressure is led into ports 73 and 76, the pressure in chambers 62 and 63 presses the shafts 29 downwards and thereby the valve 27 into the closed position. When the fluid in the respective control chambers has no or only low pressure, the higher pressure in the expander chamber 25 will then open the exhaust valve 27.

Piston 66 of shaft 30 of valve 24 forms on both axial ends the control chambers 64 and 65. The inlet valve 24 is thereby forced up or down into open or closed position, depending thereon, into which control chamber portion the high pressure and the low pressure are led. If the high pressure is led to port 74 the inlet valve 24 is opened, while it is closed and seated in exhaust piston 27 when the high pressure is led into the port 75 and thereby into chamber portion 65.

FIG. 1 also shows that a light spring 80 may be set to keep the inlet valve 4 slightly closed, as long as the vacuum in the compression chamber 1 is too weak. Spring 80 may be held by holder 81 of valve 4.

FIG. 4 with the thereto belonging cross-sectional FIG. 5 illustrates that the compressor piston 2 and the expander piston 26 may be connected to a power outlet, like a crank shaft or may be combined together by a transmission or connection means 82. Means 82 may be a piston shaft. The Figures show the combustion chamber housing 18 and the combustion chamber 7 with the power gas transfer passage 22 on the left side of the Figure. This embodiment also demonstrates, that the space 35 may be combined with space 39 and form an annular chamber 35–39 with an entrance port 135 and an exit port 139 in the cylinder wall 125. Fluid under pressure, for example oil or water, may be sent through port 135 into chamber or space 35. From there it can flow through passage 136 into the sealing chamber 137 which is between the piston rings 44 formed around the piston 26. The sealing fluid then either leaves the sealing space 137 through passage 138 and exits port 139 or it is kept inside of the sealing space 137 depending on the actual design or requirement. It is for example possible to set a relief valve, for example like that of housing 93, onto the exit port 139, while the entrance port 135 may be connected for example through fluid passage 204 to a fluid pressure supply source 205. The setting of the relief valve will then define the pressure in the sealing fluid in sealing chamber or sealing space 137.

This embodiment, however, also illustrates that the space 35–39 may act as a deformation prevention chamber. The high pressure in cylinder 25 tends to enlarge the inner diameter of the cylinder wall 125. The chamber 35–39 now defines an inner cylinder wall 225 and an outer wall 125. According to the invention, the result of the arrangement is that when the pressure in chamber 35–39 is kept equal to the pressure in the cylinder 26, the inner wall 225 of the cylinder can not deform under inner pressure in the cylinder 26, because the pressure inside and outside of the inner wall 225 is now equal. A deformation under pressure in space 35–39 of the outer wall 125 is irrelevant, since the outer wall 125 has not to seal the piston 26. Thus, if according to the invention the pressure in chambers 35–39 and 137 is kept equal or substantially equal to the pressure in the cylinder 26, all outward deformation of the inner cylinder wall 225 is prevented, while at the same time the piston is absolutely sealed in the cylinder. Because the equal pressure in sealing space 137 prevents any leakage flow over the upper piston ring 44. When equal pressure acts on both axial ends of the upper piston ring 44 there can not be a leakage flow over it and thereby the piston 26 is by sealing space 137 in combination with the piston rings 44 perfectly and absolutely sealed. Since, however, the pressure in cylinder 25 is all times varying, the pressure in the sealing space 137 should also vary and should vary parallel to the pressure in the cylinder 25 at equal times.

The control of the power and timing of the control valve 61 as well as of the pressure in the sealing space 137 as well as the control of the combustion cycle style of the engine may be done electrically, electronically, mechanically, pneumatically or hydrostatically. The embodiment of the FIGS. 4 and 5 shows the pneumatic or hydrostatic solution by way of example. The piston shaft 82 has a control element 85 kept between holders 83. The holders 83 may be set by fasteners 84. Control element or control drive element 85 has an outer face, which forms a control drive face 90. First control apparatus 93 has a first sensor piston 92 which may be loaded by spring 97. Control recess 192 defines in response to the axial movement of sensor 92 whether entrance port 94 connects to the passage 95 or 96. Passage 201 unloads the chamber which contains the spring 97. Spring 97 presses the sensor piston 92 towards the control drive face 91. Control face 90 forms different distances from the axis of the piston shaft 82 at different axial distances from the respective piston 2 or 26. Thus, when the piston 2 or 26, or both, reciprocate, the shaft 82 reciprocates and at such reciprocation the control drive face 90 or 91 moves together with the opposing spring 97 the first sensor piston 92 deeper or less deep into the housing 93.

Also similarly working is the second sensor piston 98 of housing 99. It is pressed by spring 200 towards the control drive face 90. Accordingly it also moves deeper or less deep into its housing 99 when the piston shaft 82 reciprocates. Housing 99 forms a pressure setting valve arrangement. Passage 204 is connected to a pressure source, for example, 205 with entrance port 206 and exit port 207. The valve 203 closes passage 204 to exit passage 202 or opens the communication between these passages, depending on the thrust force of spring 200. When now during reciprocation of the shaft 82 the second sensor piston 98 is moved deeper into the housing 99, the valve 203 is pressed stronger into its seat and closes the passages for a higher pressure, while it is pressed softer into its seat and opens the passages at a lower pressure when the sensor piston 98 is permitted by the control drive face 90 to move more towards the axis of shaft 82 and thereby more outwards in housing 99.

The drive control face 90 of element 85 is in the middle of the FIG. 4 seen in a specific cross-section. The line 91 indicates that after a pivotal movement around the axis of shaft 82 the control face 90 will have another configuration, namely that of 91. Still other configurations of drive control faces are shown by 191,192,193 of FIG. 5. By turning the element 85 around its axis, the face 191 will give smaller distances 192 and longer distances 193 from the axis. Thereby the strokes of sensor pistons 92 and 98 can be varied during the reciprocation of shaft 82 and of pistons 2 or 26. The turn or pivotal movement of element 85 around its axis can be effected by turning the control guide member 87 by handle 89 in the pivotal movement of arrow 208. Element 85 has a finger 86 which can axially reciprocate in the guide slot with guide face 88 of member 87. Thereby the pivotal movement of the pivotable but not reciprocable member 87 is transferred to the reciprocable element 85. Consequently, during operation of the engine at compression and expansion strokes, the strokes of the sensor pistons 92 and 98 or more of them can be varied depending on the configurations of the control guide face(s) 90.

The control apparatus 92 and the control apparatus 99 respectively can now be used to control the timing and force or pressure of the control device 61 for the valves and of the varying pressure in sealing space 137.

The arrangement can further define, for example, by the pivotal movement of member 87, whether the engine shall operate in a first combustion cycle, in a third combustion cycle or in a second combustion cycle therebetween. In the first combustion cycle the inlet valve 24 will be open only a short time. The engine will then operate very economically because the gas will expand to a large degree until a low pressure during the expansion stroke of piston 26. In the third combustion cycle the valve 24 will be open for a long time after the inner dead point of the piston stroke. The engine will now operate in the very high power cycle, the third combustion cycle. This cycle is however not economical, because it consumes a great quantity of fuel for making the higher power. It loses efficiency because the gas will now expand only to a higher output pressure during the expansion stroke and gas will exhaust unused with a higher pressure than in the first combustion cycle. The second combustion cycle is any desired cycle of timing of opening of the valve 24 between the first and third cycles. There may also be fourth cycles, for example, wherein the valve 24 already opens before the inner dead point of the piston 26 is reached. That may lead to a second or further combustion under very high pressure in the then closed cylinder 25. The fifth cycle would be to open the valve 24 so early before the inner dead point of piston 26 is reached that the cycle brakes the engine. These many possibilites of controls of the engine are possible by the arrangements, which are shown by ways of example in the Figures of this application.

Very essential in my invention is that the valves of the compressor and of the expander are operated differently. The compressor valves operate automatically under the pressures of the air. But the valves of the expander are opened and closed from the outside or by inclusion of outside help. For example the inlet valve of the expander is exclusively operated from the outside. The exhaust valve opens, when the outside thrust is reduced by an operation from the outside. Important are plural shafts on the exhaust valve in order to obtain and maintain a uniform thrust load on the valve, while the plural shafts are to be set in such a style that a substantially free exhaust path is maintained. The pure gas collection arrangement should be set vertically to work properly and to permit vertically extending dust collection chambers around it.

The engine of my invention may also contain one or more of the following:

(A) A combustion engine, of my "A-type", comprising a compression chamber 7,46 having inlet means 3, a combustion chamber 7 including separation means 10,13, ignition means 9 and fuel supply means 40, an expansion chamber 25 with inlet and outlet means 22,28, passages 6,22 from the compression chamber 1 to the combustion chamber 7 and from the combustion chamber 7 to the expansion chamber 25,46 and moveable members 2,26,45 said chambers, which expand and reduce said chambers in periodic cycles; the expansion chamber 25 is provided with at least two valves 24,27, which have actuation-transfer means 29,30 to extend outward from the valves through the respective chamber head 34 wherein they are guided; while the expansion chamber valves 24,27 are controlled by a respective valve control device in suitable timed relation respective to the respective expansion and exhaust of the expansion chamber 25 and thereby in proper relation to the movements and positions of the moveable member 26 in the expansion chamber; the compression chamber 1 has an inlet valve 4 and is provided with an outlet valve 5 between the compression chamber and the passage 6 from the compression chamber to the combustion chamber 9; the two valves of the compression chamber have coinciding longitudinal medial axes for reciprocal movement along the coinciding axes; the fuel supply means is substantially connected to combustion chamber; and the actuator means are subjected to actions of the control device; as substantially known in the art; and my improvement consists therein; that actuator means includes plural shafts 29,30 with parallel axes which are distanced from each other, whereby uniform load is secured to the valves 24,27 of the expansion chamber when they are opened and closed, while a substantially undisturbed path for the flow of fluid into and out of the expansion chamber is maintained.

(B) A combustion engine of my "B-type", which improves the former art by the provision that the combustion chamber 7 contains a rotary collection member 13 which is provided with a puregas passage 21 to collect pure and clean gas from the combustion chamber to transfer it through a power gas passage 22; the rotary collection member is provided with radial blades 14,15 to actuate an at least partially radial movement of unpure fuel portions away from the rotary collection member and into respective dust collection spaces in the combustion chamber; the puregas passage is a medial bore 21 in the collection member 13 and is communicated by radial passages 19,20 which extend from the puregas passage to the combustion chamber; the centrifugal force which is acting during rotation of the collection member in the radial passages prevents the entering of non - puregas particles into the puregas passage; the rotary collection member extends with it's axis substantially vertically from the top 31 into the combustion chamber 7, has radial passages 19,20 for the collection of said pure gas into the puregas passage 21; the rotary collection member 13 is rotatable borne in a respective vertical bearing 31 and provided with drive means 23 to provide a rotation to the rotary member and provided with radial exit bores 58 to transfer the pure gas into the power gas transfer passage 22, and the radial passages 19,20 are provided above the blades 14,15 in order that the blades supply radial centrifugal force to unpure fuel particles to move them away from the rotary collection member before unpure particles would reach the radial passages to collect the gas.

It is preferred to use this improvement in a combustion engine, which comprises:

a compression chamber 7 having inlet means 4,3, a combustion chamber 7 provided with ignition means 19, an expansion chamber 25 with inlet and outlet means 22,24,27,28, passages 6,21,22 from said compression chamber 7 to said combustion chamber 7 and from said combustion chamber 7 to said expansion chamber 25, and moveable members 2,26 in said compression and expansion chambers, which expand and reduce the volumes of said compression and expansion chambers in periodic cycles, the expansion chamber 25 is provided with at least two valves 24,27; the valves have means 29,30 to extend outward from the valves through a respective chamber head 34 wherein they are guided; the valves 24,27 are controlled by a respective valve control device in suitable timed relation respective to the respective expansion and exhaust of the expansion chamber and thereby in proper relation to the movements and positions of the moveable member in the expansion chamber 25, while the compression chamber is provided with an outlet valve 5 between the compression chamber 7 and the passage 6 from the compression chamber to said combustion chamber, and the two valves of the compression chamber 1 have coinciding longitudinal medial axes for reciprocal movement along coinciding axes.

My engine may further include the following known or novel means singly or in combination with other embodiments of my engine or with engines or devices of the former art; when (C) the moveable member is a piston 7,26,45, one piston 1,45 is provided in the compression chamber 1,46, one other piston 26 is provided in the expansion chamber 25,46, the compression chamber 7,46 and the expansion chamber 25,46 are cylinders, 1,25,46, the piston 2,25,45 is provided with sealing piston rings 44 close to the bottom end and to the top end of said piston, 2,25,45, a space 37 is formed around the piston 2,26,45 between the piston rings 44 and sealed by the piston rings 44 along the cylinder 7,25,46; a passage 36,38 extends through the cylinder 1,25,46 into a space 37 between the rings 44, and, sealing fluid 35,39 is supplied through the passage 36,38 into the space 37, whereby the passage 35 to 39 is a seal fluid passage and the space 37 between the piston rings 44 is a sealing space for sealing the piston 2,26,45 in the cylinder 7,25,46.

or;

(D) the cooling passage 36 is communicated to a seal fluid containing space 35 of a higher pressure, 35 a seal fluid outlet passage 38 extends from the sealing space 37 through the cylinder 1,25,46 to a sealing fluid containing space 39 of a lower pressure, the sealing fluid is passed under the difference in the pressures 35,39 through the sealing space 37 between the piston ring 44 to permanently and effectively seal the piston 2,26,45 and said cylinder 7,25,46, and, the fluid in the space between the piston rings 44 may serve as an effective seal in addition to said piston rings 44 to seal between said piston 2,26,45 and the cylinder, 7,25,46.

or;

(E) the combustion chamber 7 burns a fuel in air under a given pressure, and the expansion chamber 25 has a larger cross-sectional area than compression chamber 7 or a larger expansion volume than the compression volume of the compression chamber 7 is at the same cycle of operation of the engine.

or;

(F) control means or valve means are provided to control the inlets, outlets and passages of the compression and expansion chambers 7,25,46 in a proper relation to provide, that at constant pressure combustion in the combustion chamber 7 the delivery volume of the compression chamber 7,46 to the combustion chamber 7 remains considerably less than the expansion volume of the expansion chamber 25,45 taken from the combustion chamber 7 and the expansion chamber 25,46 provides a higher power than the compression chamber 7,46 consumes at a respective cycle and time.

or, (G) the compression—and, or—expansion chamber(s) 7,25,46 has (have) has (have) inlet valves 14,48, compression discharge valve(s) 5,49, power gas transfer valve (s) 24,50 and exhaust valve (s) 27,51, and, the inlet—and compression discharge—valve(s) 7,48 act automatically under the forces of gas applied against them, while the power gas transfer valve(s) and the exhaust valve(s) are closed by thrust means, e.g.: springs, and opened by a respective valve control device in respective timed relation.

or, (H) a combustion chamber 7 contains a rotary collection member 13 which is provided with a puregas passage 27 to collect pure and clean gas from the combustion chamber 7 to transfer it through said power gas passage 22 and, the rotary collection member 13 might be provided with radial blades 14,15 to actuate an at least partially radial movement of unpure fuel portions away from the rotary collection member 13 and into respective dust collection spaces 16,17 in the combustion chamber 7.

or;

(J) adjustment means are provided to vary the ratio of the volume of the respective compression volume to the respective expansion volume in order to obtain or maintain a respective pressure of the combustion process, or, the adjustment means is utilized to run the engine in a turbine like constant combustion process or in a second compression and combustion process in the respective expander chamber or in any combustion process therebetween, or the adjustment means is utilized to change during running of the engine from one of the processes to another of the processes or to change the pressure of the combustion, or the adjustment means are provided to the valve control device to vary or modify said ratio by varying, changing or modifying the times and relations of the openings and closings of the valves in relation to the position and movement of the moveable bodies, pistons, crankshafts or pressures.

or;

(K) the rotary collection member 13 is extended vertically from the top 31 into the combustion chamber 7, has radial passages 79,20 for the collection of a pure gas into a pure gas passage, 21, the rotary collection member 13 is rotatable borne in a respective vertical bearing 31 and provided with drive means 23 to provide a rotation to the rotary member 13 and provided with radial exit bores 58 to transfer the pure gas into a power gas transfer passage 22, and the radial passages 19,20 are provided above the blades 14,15 in order that the blades supply radial centrifugal force to unpure fuel particles to move them away from the rotary collection member 13 before the unpure particles would reach the radial passages 79,20 to collect the gas.

or, (L) a fuel supply means 40-43,8 is properly connected to the combustion chamber, 7, pump means 40,41,42 are provided to the fuel supply means, and, the pump means 40–42 of the fuel supply means is provided with means to supply intermittently in periodic timed thrusts respectively dimensioned quantities of fuel portions into the combustion chamber 7 in timed relation to the openings and closings of the respective compression discharge valves 5,49 of the valves.

or;

(M) My "B-type" engine which includes the speciality that the rotary collection member 13 and the pure gas collection passage 21 are provided substantially vertically with the outlet 58 of the pure gas passage higher than the inlet bores 19,20 to the pure gas passage and with the further feature, that vertically extending annular dust collection chambers 16,17,57 are provided outwardly of the rotary collection chamber for the collection of dust and heavier than pure gas particles in the dust collection chamber under the outside movement of the to be collected particles which movement is actuated by the centrifugal force which is caused by the rotation of the rotary collection chamber 13 and its blades 14,15;

or;

(N) The combination of my "A-type engine" with the speciality of self-acting inlet and outlet valves 4,5 of the compressor 1,2 which defines, that the mentioned valves of the compressor act exclusively under the influences of pressures in air or gas, while the expander valves 24,27 are at least partially controlled from the outside of the engine which defines that the inlet valve 24 of the expander is exclusively controlled by forces from the outside for the opening and closing of the inlet valve, while the outlet valve 27 of the expander is forced into closing position by means f.e. in 611 from the outside at specific times, but the means from the outside give the outlet valve free at another time of the cycle, which permits the outlet valve 27 of the expander 25,26 at this other time open itself under the pressure of the gas in the respective expansion chamber;

or;

(O) A cylinder 25 with a reciprocable piston 26 therein and a cylinderwall forming the housing of the cylinder, while the piston is provided with piston rings 44 close to the upper and bottom ends of the piston to form a sealing space 37,137 therebetween with the sealing space provided with a passage 136 towards it, and the cylinder wall contains a pressurable space 35 with an inlet port 135 and a communication to the mentioned passage 136 whereby the pressurable space divides the cylinder wall into outer and inner cylinder wall portions 125,225 and fluid under pressure is supplied to the inlet port of the pressurable space to form and maintain a pressure in the pressurable space for preventing radial deformation of the inner wall portion 225 of the cylinder wall;

or;

(P) My cylinder of "O", connected to a control means f.e. 82 to 99 etc., which is responsive to the stroke of the piston 26 in the cylinder 25 and the control means provides and secures that in combination with a fluid pressure supply source 205 the pressure in the pressurable space 35 varies in unison and parallel to the pressure in the cylinder at the respective piston stroke in the mentioned cylinder.

or;

(Q) a device for the intake and expelling of a fluid which includes a member 82,85 connected to a displacement means 2,26 at a displacement stroke with the member 82,85 provided with configurated outer face portions 90,91, directed to sensors, while sensor pistons are provided to engage the respective portion 90,91,191,192 of the mentioned outer face and to be moved by the movement of the mentioned outer face portions along the tips of the sensors, whereby the sensors are able to control a power to flow at a specific time in a specific direction for the control of valves and/or spaces of the mentioned device;

or;

(R) the device of "Q" which includes hills and valleys on the respective outer face port on, which such hills and valleys are provided longitudinally to the axis of the member 82,85 and in addition thereto also angularily along the periphery of the respective outer face portion 90,91,191,192,193 while a pivotable or revolvable guide means 87 is provided with a guide slot 88 with guide faces thereon to receive therein and thereon a finger 86 of the mentioned member 82,85 for the purpose of angularily turning the outer face portions or control face portions 90,91,191,192,193 respective to the respective sensor or sensor piston(s) 92,98 during the upwards and / or downward stroke of the mentioned member 82 and the respective displacement member or piston 2,26;

or;

(S) my device of "Q" combined with my device of "N" with the device of "Q" applied by way of example, in order to provide a combustion engine of my invention with the possibility of running it in a first combustion cycle of high performance and efficiency and at another time in a third combustion cycle of high power and at another time with any ratio of the mentioned combustion cycles therebetween by means of opening the inlet valve of the expander longer or less long in the neighborhood of the inner dead point of the piston or displacement member for varying the volume of maximum pressure gas to the expander for example by means of turning the mentioned guide mans 87 of my "R" device.

My invention may also define, for example by FIGS. 1 to 3, the following:

(T) An engine of my "T-type", comprising, that the compression chamber 7 is the same chamber as the expansion chamber 25, constituting a variable volume chamber, 46, at least four passages 52,53,54,55 are provided to the variable volume chamber; 46; at least one valve 48,49,50,51 is provided to each of the passages; 52 to 55; the variable chamber 46 acts temporary as a supply chamber 7 in intake and compression activities and thereafter temporary as a power-chamber 25 in expansion and exhaust activities; a valve control device is provided to the valves; the control device opens the valves 48 to 51 and closes the valves in suitable and periodic timed relation to the activities and to the respective movements of the moveable member; 45; and, the control device firstly opens the inlet valve 48 of the valves to permit the entrance of fluid into the variable chamber, 46, thereafter opens the compression discharge valve 49 of the valves, thereafter opens the power gas transfer valve 50 of the valves, and thereafter opens the exhaust valve 51 of the valves;

or;

(U) the engine of the "T-type", with the chamber 1,25 and the moveable member are cylinder 1,25 and piston 2,26 of substantially conventional four cycle engine structure, but the piston 2,26 has a configuration at its top to prevent dead space in the cylinder 1,25 and the cylinder head 33,34, also is partially formed to prevent dead space in the cylinder 1,25 when the piston 1,26 is moved into its inner dead point position most close to the cylinder head, 33,34,47; the cylinder head 33,34 includes the four passages 52 to 55 or 3,6,21,22,28 and the four valves, 48 to 51 or 4,5,24,27; a valve control device is mounted on the cylinder head and driven from the crankshaft which controls the strokes of the piston 1,26,45; the combustion chamber 7 is connected to the cylinder 25,46 and to two of the valves, 24,27,50,51; the combustion chamber 7 is provided with means 10,11,12,13,14,15,16,17,57,19,20,21 to separate unpure fuel from pure combustion fuel, a combustion of fuel in air is ignited 9 and maintained in the combustion chamber 7 and fuel 40,43,8 is moved into the combustion chamber 7, while compressed air is moved from the cylinder 7,46 into the combustion chamber 7 and heated gases are moved from the combustion chamber 7 into the cylinder 25,45; an inlet passage 3,52 extends over an inlet valve 4,48 to the cylinder 7,46; a compression discharge passage 6,53 extends from the cylinder 7,45 over a compression discharge valve 5,49 to the combustion chamber 7, a gas transfer passage 19-22,54 extends from the combustion chamber 7 over a power gas transfer valve 24,50 to the cylinder 25,46; an exhaust passage 28,55 extends over an exhaust valve 27,51 from cylinder 25,46 through the cylinder head, 34,47; the valve control device opens and closes in timed relation at a supply-revolution of the crankshaft, the inlet valve and the compression discharge valve; and, at a power - revolution of the crankshaft the valve control device opens and closes in timed relation the power gas transfer valve and the exhaust valve;

or, (V) the engine of the "U-type", with the cylinder 46 replaced by at least two cylinders 7,25 and, one of the cylinders 7 acts in the supply-revolution of the crankshaft while the other of the cylinders 25 acts in the power-revolution of the crankshaft, each of the cylinders at two revolutions of the crankshaft acts once in the valved cycle of the supply-revolution and once in the valved cycle of the power - revolution; the combustion chamber 7 is communicated by at least each one of the compression discharge passage 6 to each of the cylinders 1,25 and by at least one of the power gas transfer passage 22 to each of the cylinders 1,25;

or, (W) the engine of my "U-type", with the timings of said valves set to assure that the inlet valve 4,48 stays open for a period of a portion of a revolution over the outer dead point of the crank shaft to limit the effective size of the compression stroke to a portion of the size of the expansion stroke, when the cross-sectional areas through the cylinders 7,25,46 are equal and the strokes defined by the crankshaft in the cylinders 7,25,46 are equal and/or, the timing of the valves are set to assure that the power-gas-stroke transfer valve 24,50 of the expansion cylinder 25,46 stays open for a period of a portion of a revolution over the inner dead point of the respective piston 26,45 to permit the expansion cylinder 25,46 to take a greater volume of gas away from the combustion chamber 25,46 than the compressor cylinder 7,46 supplies into the combustion chamber 7, the main pressure range of expansion stroke is led to the crankshaft to the medial way of movement of said crank shaft at the expansion stroke, whereby the expansion stroke gives more power than the compression stroke consumes and/or, whereby the power stroke is led onto the most effective portion of the way of the crank at the expansion stroke.

The guide means, pivotable body, control faces and sensors, for example the means 82 to 99 of FIG. 4 for example also in combination with FIG. 1 or with FIGS. 2 and 3 may also be called adjustment means, control means or otherwise. They may help or decide, actuate or control the respective valves, strokes, sealing spaces or they may define and actuate or control the respective combustion cycle, for example, the mentioned first to fifth combustion cycles or one or more thereof. Other features of the invention are:

a device, comprising, a fluid containing working chamber 2,25 in a housing, passage means 3,6,22,28 to pass fluid into and out of the working chamber and a displacement member 2,26 which periodically increases and decreases the volume of the working chamber whereby during such increase and decrease of the volume of the working chamber the pressure in the fluid in the working chamber varies, while an extension f.e. 82 is provided on the displacement member to extend from the working chamber to a control element 82,85, and, means are provided to influence the actions and behaviours of the fluid in the chamber in response of a movement of said control element;

or,

The above device with the provisions, that the housing is a cylinder 25 and the displacement member is a piston 26 which reciprocates in the cylinder, the cylinder has a cylinder wall with an annular space 35 in the wall which has an entrance port, f.e. 135, and, a fluid pressure supply means f.e. 205 is provided and connected to the space in the cylinder wall to supply fluid under pressure into the space;

or, with the further provision, that the space 35 divides the cylinder wall into an inner portion 225 and an outer portion 125 with the inner portion subjected to the pressure in the fluid in the cylinder, and, the pressure in the fluid in the space is substantially equal to one of the pressures in the fluid in the cylinder to counter the force of pressure which acts from the interior of the cylinder against the inner portion of the cylinder wall;

or with the further improvement, that control means 85 to 99 etc. are provided to the fluid pressure of the fluid pressure supply means to vary the pressure in the fluid in said space in the cylinder wall during the stroke of the piston to obtain at equal times about equal pressures in the fluids in the cylinder and in the space in the cylinder walls.

or, the above device with the provisions, that the extension 82 is provided with a control element 85 which includes outer faces 90,91,191,912,193 which form control faces of different extensions from an axis wherealong the extension and the control element reciprocate, and a sensor 92,98 is provided and directed towards a portion of the control face of said control element and transfer means 86 to 99 etc. are associated to the sensor to transfer movements of the sensor into force and to transfer the force to other control means which control actions of accessories of the device;

or with the further provision, that sensors control the opening and closing of valves e.g. 24,27 to the working chamber in response to the reciprocation of the displacement member;

or with the probable additional provision, that a turnable guide means 87 is provided to the element, the guide means includes a guide way 88 for the reception and guidance of a portion 86 of the element during the reciprocation of the element, the control face(s) of the element includes portions 90,91,191,192,193 of different distances from the axis at different angles around the axis, the guide means is turnable around the axis, whereby any turn of the guide means 87 turns the element 85 in unison with the guide means, and, turn of the guide means during reciprocation of the element varies the meeting of the sensor 92,98 with the control face 90,91 etc. of the element, the timing of opening and closing of valves on the device in relation to the reciprocation of the piston is obtained during reciprocation of the element and may be used to vary the respective time and cycle of supply of fluid into and out of the cylinder.

Figure 6:
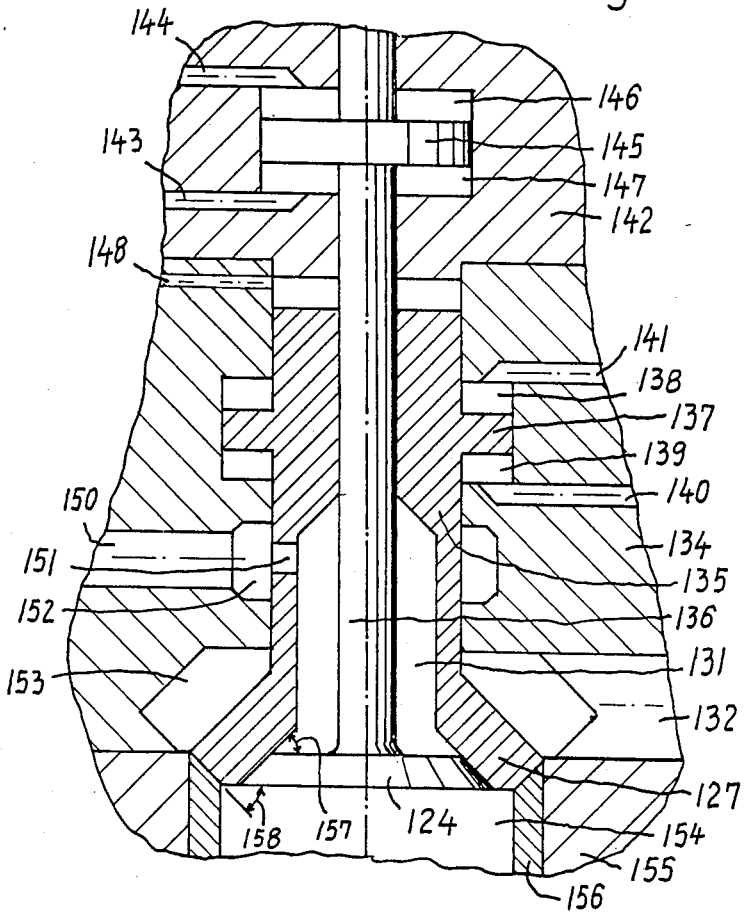
FIG. 6 is a longitudinal sectional view through a valve arrangement of the invention.

In FIG. 6 two co-axial valves 124 and 147 are illustrated. The inlet valve 124 is located inside of the outlet valve 127. The inlet valve has the valve seat with angle 157 for streamlined flow and outlet valve 127 has the valve seat with angle 158 from streamlined flow of the gas or air. The inlet valve has the valve shaft or valve stem 136 with which it extends through a concentric bore through the stem 135 of the outlet valve. Both valves are axially movable in a limited extent. These valves are provided with actuator means to secure their axial movement and thereby the opening and closing of the respective valve seats at the respective proper times. In the Figure the actuator or actuating means are pistons in respective cylinders. Inlet valve 124, thus, has on its valve stem the piston 145 movably provided in chambers 146 and 147 of the cylinder housing 142. Passages 144 and 143 communicate to the respective chambers 146 and 147. The outlet valve has on its valve stem 135 the piston 137 movably provided in cylinder chambers 138,139 of the cylinder housing 134. The passages 140 and 141 communicate to the chambers 139 and 138, respectively. The passage chamber 153 extends around a portion of the exit valve and communicates with passage 132 to let the gas flow out of the engine cylinder 154 when the outlet valve opens by departing from its seat 158. The inlet valve stem 136 is partially surrounded by a chamber 131 inside of the outlet valve stem 135. A passage 151 extends from the mentioned chamber 131 through the stem 135 of the outlet valve and ports into the passage chamber 152 which is communicated to the passage 150. Air or gas flows from passage 150 through chamber 152, passage 151 and chamber 131 towards the inlet valve seat 157 and flows along seat 157 into the engine cylinder 154 when the inlet valve 124 departs from its seat and thereby opens the inlet valve.

For the actual operation the passages 143,144,141,140 are communicated to respective fluid flow supply and/or control means, as for example, such which are associated to the movement of the engine's piston or pistons and fluid is thereby led through the respective passage to press the respective piston of the respective valve stem in the respective axial direction at the respective proper time. Passage 148 is an unloading passage which prevents compression of air or gas on the top end of the stem of the outlet valve. Cylinder liner 156 surrounds the cylinder 154 in the engine's housing 155.

Herebefore my engine has been described in its basic principle. For the practical application, is is however, desired to obtain a maximum of reliability of the cleaning arrangement in order to obtain a long life of the engine by preventing any kind of dust to enter into the cylinders of the expander.

FIG. 7 with its cross sectional FIG. 8, shows the sectional view along the arrowed line of FIG. 7, now show an actual application of the improvements to an engine. In FIG. 7 two devices are coupled together. The expander is with its axis set into coincidence of the elongated axis of the compressor. The compressor 404 and the expander 401 are mounted on a base plate 421 with a flexible clutch 402,403 mounted between the compressor and expander to clutch the shaft of the compressor to the shaft of the expander. In practice the expander and compressor may be old engines from the engine scrap yard because thrown away old car or truck engines are often still reliably useable as coal burning engines if the engine used for the compressor has a smaller delivery volume than the expander has consumption volume. In the Figure the other end of the shaft of the expander is provided with an outgoing gear 420 to engage a gear 422 of an intermediate shaft 441 which on its upper end has a gear 445. An additional gear 418 may be provided on the shaft of the compressor or of the expander. In the Figure it is shown on the shaft of the expander. This gear 418 may be used to drive a coal preparation device in which natural coal would be subjected to milling or grinding the coal to powder and, perhaps, to clean it from ashes and foreign particles in a pre-cleaning device. The cleaning arrangements of the invention are in this Figure provided in the cleaning housing 478. The compressor is provided with a communication head 459 which is inserted between the compressor and the cleaning housing 478, while a respective communication head 460 is provided between the expander and the cleaning housing. The head 459 has passages 423 to 425 which go from the respective delivery valves of the compressor to the combustion chamber 431 in housing 478. The head 460 leads the outgoing pure gas passage 430 to passage 429 which branches into passages 426 to 428. These passages 426 to 428 lead to the intake valves of the cylinders of the expander.

The fuel supply arrangement is provided by pump 435 with this pump pumping fuel or fuel powder, fuel-slurry from the fuel entrance port 434 through the fuel supply passage 433 into the combustion chamber 431. Ignition means 432 may be provided to the combustion chamber to start the ignition at start of the engine. The combustion chamber communicates to the first cleaning- or fluid separation- arrangement and particularly to its cleaning- or fluid separation-chamber portion 479.

The cleaning housing 478 has a plurality of cleaning chamber portions 479 to 481 with therein revolving collection members 452 to 454. The collection members have the blades and puregas passages as known from FIG. 1 in principle. The respective dust collection spaces 436,439, 440 are provided below the cleaning chamber portions. The top portion of the cleaning housing is provided with outer bearings and inner bearings for the revolvable bearing of respective portions of the collection members. The outer bearings are provided above the inner bearings and distances, forming spaces, are provided between the outer and inner bearings. These spaces or distances are provided in order to locate therein the respective gears to revolve the collection members. Collection member 454 has the gear 446 which meshes with the already mentioned gear 445. Collection member 453 has two gears, 447 and 448 of which gear 447 meshes with gear 446, while gear 448 meshes with the gear 449 of collection member 452. Gear 446 has more teeth than gear 447 and gear 448 has more teeth than gear 449. Consequently, collection member 453 is revolved with a higher rotary angular velocity than collection member 454 and collection member 452 is revolved with a higher rotary angular velocity than collection member 453, when the engine runs and gear 420 of the engine drives over 442,441,445 the gear 446.

The outer bearings are shown by 450 while the inner bearings are shown by 451 and these bearings have a shaft portion of the respective collection member revolvably borne in cylindrical faces of the housing 478. The inner bearings are axially longer than the outer bearings because the inner bearings form two inner bearing portions wherebetween the transfer recesses 482 are provided and are preferred to be annular grooves which extend radially into the housing 478 to collect pure gas from outgoing bores 58 of the respective collection member. The mentioned outgoing bores 58 are in principle known from FIG. 1. An intermediate passage 439 leads from the transfer recess which meets the outgoing bores 58 of collection member 452 to the bottom portion of chamber portion 480 and thereby under the bottom of collection member 453. Another intermediate passage 440 leads from the transfer recess which meets the outgoing bores of collection member 453 to the bottom portion or chamber portion 481 and thereby to below the bottom of collection member 454. The last pure gas passage portion 430 leads from the transfer recess which meets the outgoing bores of collection member 454 to the already mentioned passage 429 and thereby to the expander. Dust collection spaces 463,437,438 are provided in the respective cleaning chamber portions 479 to 481. The figure also shows partially the pistons 405 to 407 in cylinders 411 to 413 of the compressor and pistons 408 to 410 in cylinders 415 to 417 of the expander.

Due to the provision of different numbers of teeth on the mentioned gears, the individual pure gas collection members revolve with different rotary velocities. This is indicated by arrows of different lengths in Figure 8. The arrows also indicate the direction of revolution. One sees that the right collection member 454 revolves slowly and clockwise, the medial collection member 453 revolves faster and anti clockwise while the left collection member 452 revolves fastest and clockwise. These appearances are indicated by the mentioned arrows 459 to 461.

The effect of this arrangement of the invention is that the gas or fluid is cleaned or lighter fluid is separated from heavier fluid in a plurality of individual cleaning chamber portions by individual pure gas or light fluid collection members. This is important in accordance with this present invention, because natural coal or coal powder and coal slurry contain different foreign particles, minerals and the like of different specific gravity. Too fast revolving collection members may cause turbulence and prevent the sinking of light dust into the dust collection chambers. Too slow revolving collection members may fail to separate dust of low specific gravity from the pure gas because the velocity of the gas may suck light dust into the puregas passage. Such drawbacks are prevented by the different rotary velocities of the individual cleaning or separation arrangements of these figures of the invention. Each individual collection member now separates different styles of dust and of foreign particles from the gas or fluid. Numerals 456 and 457 indicate holding places for bolts to bolt the cleaning housing to the mentioned heads 459 and 460.

FIG. 8 further shows that it is preferred in accordance with this invention to bend the blades 15 rearwardly respective to the rotary direction at their radial outer portions. Still more important and effective for the prevention of entering of dust or foreign particles into the respective pure gas passage 21 is the provision of pipes 455 which contain the ingoing bores 20 to the pure gas passage or light fluid passage 31 of the respective collection member. These pipes are preferred to be also bend rearwardly respective to the direction of rotation at their radial outer portions. This direction and radial length of the pipes 455 effectively prevents the movement of dust or of foreign particles towards the respective pure gas passage 21.

Figure 9:
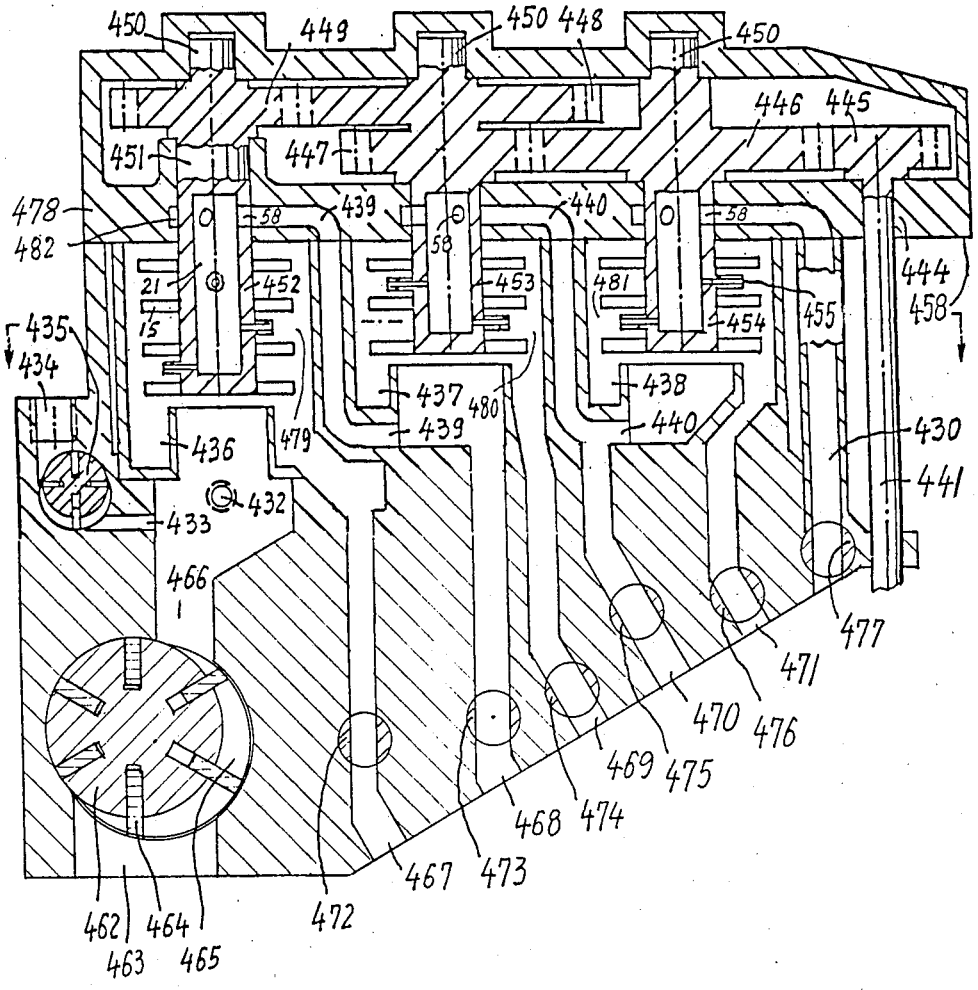
FIG. 9 is a sectional view through a fluid separation device of the invention which also may be applied to the engine of the invention.

FIG. 9 shows the cleaning housing 478 of FIGS. 7 and 8 in a separated form and with further improvements. Equal reference numbers in FIGS. 7,8 and 9 show equal parts and equal functions.

A first specialty of FIG. 9 is the provision of exit passages with valves to the respective pure gas and light fluid passages and to the respective dust or heavy fluid collection chamber. The valves 472 to 477 serve for the individual opening and closing of the respective passages. Passage 467 leads to the collection chamber 436, passage 468 leads to the intermediate passage 439, passage 469 leads to the collection chamber 437, passage 470 leads to the intermediate passage 440 and passage 471 leads to the collection chamber 438. Valve 477 is provided to the final pure gas or light fluid passage 430.

Thus, by opening valve 472 the dust or heavy fluid may be exited from chamber 436, by opening valve 473 the pure gas or light fluid may be exited from the intermediate passage 439, by opening valve 474 the dust or heavy fluid may be exited from chamber 437, by opening valve 475 the pure gas or light fluid may be exited from the intermediate passage 440, by opening valve 476 the dust or heavy fluid may be exited from chamber 438 and by opening valve 477 the pure gas or light fluid may be exited from the final pure gas or light fluid passage 430. While three cleaning arrangements are illustrated in these Figures, there may be two or more than three such cleaning arrangements provided.

A further feature of the arrangement of FIG. 9 is that this arrangement can also be used as a fluid separation or cleaning device. Fluid is either liquid or gas. A mixed or unpure fluid may be pumped by pump 462 with vanes 464 by chambers 465 from an entrance port 463 into chamber 479 by a continuous operation while the shaft 441 is driven for revolving by a respective power source. The device of FIG. 9 will then separate the fluid of different specific gravities. The lighter fluid is therefore called "light fluid" while the heavier fluid is called "heavy fluid". The light fluid may be gas, oil or the like, the heavy fluid may be water or any other fluid which is heavier than the light fluid. It is now easy to understand that the different rotary velocities of the collection members will very finely and accurately separate the lighter fluids from the heavier fluids. This has high practical value because water may become separated from fuel, from oil and the like. Oil or fuel may be contaminated with water by rainy weather and such contaminated fluids may cause trouble to engines or for other uses. Natural oil and the like may also be unclean or unpure. The device of FIG. 9 is thereby very useful either as the cleaning device for a combustion engine, as a cleaning device for fluid or as a separation device to separate fluid of different specific gravities.

Since the invention is more in detail described in the appended claims, the claims should be understood as a portion of the description of the preferred embodiments of the invention.

What is claimed, is:

1. A combustion engine, comprising, in combination, a compression chamber having inlet means, a combustion chamber provided with with fuel supply means and ignition means, an expansion chamber with inlet and outlet means, at least one passage from said compression chamber to said combustion chamber and from said combustion chamber to said expansion chamber, movable members in said compression and expansion chambers which expand and reduce the volumes of said chambers in periodic cycles, said expansion chamber provided with at least two valves, with said two valves having extensions which individually extend outwardly from said valves through a respective chamber head wherein they are guided, said valves controlled by respective control devices in suitable timed relation respective to the expansion and exhaust of said expansion chamber and thereby in relation to the movements and positions of said moveable member in said expansion chamber, said inlet means of said compression chamber provided by an inlet valve and said compression chamber provided with an outlet valve between said compression chamber and said passage from said compression chamber to said combustion chamber, wherein the portion of said passage from said combustion chamber to said expansion chambers goes through first and second cleaning arrangements which include each a respective cleaning chamber portion, said cleaning chamber portions contain revolvable collection members, said collection members are provided with at least partially substantially radially directed blades to actuate an at least partially substantial radial movement of unpure gas portions away from the central portion of the respective collection member and into a respective dust collection space, the respective collection member is provided with a pure gas passage to collect purified and cleaned gas from the respective cleaning chamber to transfer it through said puregas passage, said puregas passage is a medial bore in the respective collection member with said puregas passage communicated to ingoing substantially at least partially radial bores which extend from the respective cleaning chamber portion into said pure gas passage, whereby the centrifugal forces which act in said radial bores during the rotation of the respective collection member prevent the entering of unpure particles which are heavier than pure gas into said pure gas passage, said revolvable collection member is rotatably borne in a respective bearing and provided with drive means to effect the rotation of said collection member, a transfer portion is provided surrounding an outgoing portion of said collection member, said outgoing portion is provided with outporting bores and said transfer portion is provided with a transfer recess with said transfer recess communicating to an intermediate transfer passage, said intermediate transfer passage communicates to the second chamber of said cleaning devices with a second collection member located in said second cleaning chamber portion, and said second collection member is driven by a second rate of rotary angular velocity with said second rate different from the first rate of angular velocity with which the first of said collection members in said first collection chamber portion is driven.

2. The engine of claim 1, wherein said bearing has a shorter bearing portion and a longer bearing portion with said transfer portion provided in said longer bearing portion, while a distance is provided between said shorter and said longer bearing portion, and a gear is provided in said distance between said bearing portions.

3. The engine of claim 2, wherein said gear of said first cleaning arrangement has a smaller number of teeth than the gear of said second cleaning arrangement, and a transmission is provided between the outgoing shaft of said engine and said gear of said second cleaning arrangement.

4. The engine of claim 1, wherein at least one additional cleaning arrangement is provided between said first and second cleaning arrangements.

5. The engine of claim 1, wherein said cleaning arrangements are substantially vertically directed with said collection members extending with their axes and with their pure gas passages substantially vertically, said bearing and said transfer portion are located above said blades of said collection members, and said intermediate passage extends from one of said transfer portions to the bottom of a neighboring cleaning chamber portion of said cleaning arrangements.

6. The engine of claim 5, wherein individual ports with opening and closing valves are provided to said intermediate passage and to said dust collection chambers.

7. The device of claim 1, wherein said blades have radially inner portions and radially outer portions with said inner portions substantially radially directed while said radial outer portions are rearwardly directed with respect to the angular rotary direction of rotation of the respective collection member, and said bores are extended into pipes with said pipes, having an inner end and an outer end while said inner end is provided substantially radially on the respective collection member and said outer end extends rearwardly respective to said rotary direction, whereby said bores extend at their radial inner ends from said pure gas passage substantially radially, while they port with their radial outer ends rearwardly directed respective to said rotary direction into the respective cleaning chamber portion of the respective cleaning arrangement of said cleaning arrangements.

8. The engine of claim 1, wherein said cleaning arrangements are provided in a cleaning housing, said compressor is a multi-cylinder compressor of a smaller total delivery volume, said expander is a multi-cylinder expander with a larger consumption volume, and, said cleaning housing has an inlet port communicated to the delivery valves of the cylinders of said compressor and an outlet port communicated to the inlet valves of said cylinders of said expander.

* * * * *